US011371818B2

(12) United States Patent
Paterson et al.

(10) Patent No.: US 11,371,818 B2
(45) Date of Patent: Jun. 28, 2022

(54) SABOT

(71) Applicant: BAE SYSTEMS plc, London (GB)

(72) Inventors: John Andrew Paterson, Washington (GB); Benjamin Mark Davies, Usk (GB); King Kwok Wong, Crewe (GB); John Wainwright, Usk (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 17/289,424

(22) PCT Filed: Oct. 16, 2019

(86) PCT No.: PCT/GB2019/052938

§ 371 (c)(1),
(2) Date: Apr. 28, 2021

(87) PCT Pub. No.: WO2020/089588

PCT Pub. Date: May 7, 2020

(65) Prior Publication Data

US 2021/0348901 A1 Nov. 11, 2021

(30) Foreign Application Priority Data

Oct. 30, 2018 (GB) ..... 1817680

(51) Int. Cl.
*F42B 14/06* (2006.01)

(52) U.S. Cl.
CPC ..... *F42B 14/061* (2013.01); *F42B 14/068* (2013.01)

(58) Field of Classification Search
CPC ..... F42B 14/061; F42B 14/06; F42B 14/02
See application file for complete search history.

(56) References Cited

U.S. PATENT DOCUMENTS 3,430,572 A * 3/1969 Hebert ..... F42B 14/08 102/521
4,140,061 A * 2/1979 Campoli ..... F42B 8/14 102/521
4,384,529 A * 5/1983 Burns ..... F42B 14/02 102/525
4,651,649 A * 3/1987 Nussbaum ..... F42B 14/06 102/521
4,702,172 A * 10/1987 Wallow ..... F42B 14/061 102/521

(Continued)

FOREIGN PATENT DOCUMENTS

AU 2018200773 A1 2/2018
DE 4024267 A1 2/1992

(Continued)

OTHER PUBLICATIONS

International Search Report and Written Opinion received for PCT Application No. PCT/GB2019/052938, dated Dec. 2, 2019. 14 pages.

(Continued)

*Primary Examiner* — Derrick R Morgan
(74) *Attorney, Agent, or Firm* — Finch & Maloney PLLC

(57) ABSTRACT

The present invention provides a sabot (8) comprising a first material structure (12, 14) and a second material structure, wherein the first material structure is a lattice and wherein the second material structure is a solid. A munition (100) and a method of manufacturing a sabot are also provided.

20 Claims, 2 Drawing Sheets

(56) References Cited

U.S. PATENT DOCUMENTS 4,802,415 A * 2/1989 Clarke ..... F42B 5/045 102/434
5,183,961 A * 2/1993 Campoli ..... F42C 19/0834 102/521
5,198,616 A * 3/1993 Anderson ..... F42B 12/74 102/501
5,313,889 A * 5/1994 Wilkerson ..... F42B 14/02 102/524
5,789,699 A * 8/1998 Stewart ..... F42B 14/061 102/521
6,460,807 B1 10/2002 Braitinger et al.
7,152,533 B2 * 12/2006 Eches ..... F42B 14/061 102/521
7,594,472 B1 * 9/2009 Parratt ..... F42B 14/061 102/521
8,695,507 B1 * 4/2014 Musali ..... F42B 14/068 102/524
9,677,863 B1 * 6/2017 Palathingal ..... F42B 14/061
2004/0244631 A1 * 12/2004 Eches ..... F42B 14/068 102/521
2006/0032394 A1 * 2/2006 Eches ..... F42B 14/061 102/521
2016/0152314 A1 6/2016 Carlsten et al.
2020/0025541 A1 * 1/2020 Blache ..... F42B 14/068

FOREIGN PATENT DOCUMENTS

DE 102016112666 A1 1/2018
WO 2011044980 A1 4/2011
WO 2020089588 A1 5/2020

OTHER PUBLICATIONS

GB Search Report under Section 17(5) received for GB Application No. 1817680.0, dated Feb. 7, 2019. 4 pages.
GB Search Report under Section 17(6) received for GB Application No. 1817680.0, dated Feb. 27, 2019. 4 pages.

* cited by examiner

SABOT

FIELD OF THE INVENTION

The present invention relates to a sabot and a method of manufacturing a sabot.

BACKGROUND ART

Present sabots, such as casings for armour-piercing penetrators fired from gun barrels, tend to be specifically shaped and constructed to both fit in the gun barrel and withstand the strong forces that result from being fired.

As the sabot is a parasitic mass on the projectile as a whole, it would be advantageous to reduce the mass of the sabot to increase velocity and/or range of the projectile. It would also be advantageous to reduce the mass burden on munitions handlers (e.g. loaders) and reduce transport or storage requirements.

SUMMARY

According to a first aspect of the present invention, there is provided a sabot comprising a first material structure and a second material structure, wherein the first material structure is a lattice and the second material structure is a solid.

Advantageously, the lattice structure tends to reduce the weight of the sabot without compromising the function of the sabot.

The sabot may comprise a front scoop, a main body and an obturator, wherein the front scoop comprises at least the first material structure. Alternatively or additionally, the obturator may comprise at least the first material structure. Alternatively or additionally, the main body may comprise at least the first material structure. The front scoop may comprise the first material structure and a rib extending circumferentially around the inside of the front scoop. The rib may be connected to the main body of the sabot. The main body may comprise the second material structure.

The front scoop may comprise the first material structure and a third material structure, wherein the third material structure is a lattice. The third material structure may comprise a lattice having a different density to that of the first material structure.

The first material structure may be disposed in a first region of the front scoop and the third material structure may be disposed in a second region of the front scoop, wherein the first and second regions may be disposed adjacent to one another and each extend from the inner rim of the front scoop to the outer rim of the front scoop. The first and second regions may be disposed adjacent to each other circumferentially with respect to the front scoop. Alternatively, the first and second regions may be arranged adjacent to each other radially with respect to the front scoop. Alternatively again, the first and second regions may be arranged adjacent to each other axially with respect to the front scoop.

The rib may be arranged to separate the first region and second region.

The front scoop may comprise only the first and third material structure.

The lattice of the first material structure may be greater than 15% volume fraction and less than 80% volume fraction. The lattice of the third material structure may be greater than 15% volume fraction and less than 80% volume fraction.

The sabot may comprise a sintered powdered metal. The metal may be selected from any metal capable of being deposited in the form of a lattice by an ALM technique. Preferably the metal is titanium or a titanium alloy, aluminium or an aluminium alloy or an Inconel. More preferably, the powdered metal is selected from Ti6ALI4v, Inconel 718 and A20X. The first, second and third material structures may be formed from the same sintered powdered metal.

According to a second aspect of the present invention, there is provided a munition comprising a first material structure and a second material structure, wherein the first material structure is a lattice and the second material structure is a solid. The munition may comprise the sabot according to the first aspect.

According to a third aspect of the present invention, there is provided a method of manufacturing a sabot, comprising forming the sabot of a first material structure and a second material structure, wherein the first material structure is a lattice and the second material structure is a solid.

Forming the sabot may comprise using additive layer manufacturing.

The method may comprise forming a front scoop of at least the first material structure, and a main body and obturator of the second material structure. Alternatively or additionally, the method may comprise forming the obturator of at least the first material structure. Alternatively or additionally, the method may comprise forming the main body of at least the first material structure.

The method may further comprise forming the front scoop of at least the first material structure and a third material structure.

The first and third material structures may be lattices of different densities. The method may further comprise forming a rib circumferentially around the inside of the front scoop to separate the first and third material structures. The rib may extend from the main body of the sabot.

It will be appreciated that features described in relation to one aspect of the present invention can be incorporated into other aspects of the present invention. For example, an apparatus of the invention can incorporate any of the features described in this disclosure with reference to a method, and vice versa. Moreover, additional embodiments and aspects will be apparent from the following description, drawings, and claims. As can be appreciated from the foregoing and following description, each and every feature described herein, and each and every combination of two or more of such features, and each and every combination of one or more values defining a range, are included within the present disclosure provided that the features included in such a combination are not mutually inconsistent. In addition, any feature or combination of features or any value(s) defining a range may be specifically excluded from any embodiment of the present disclosure.

BRIEF DESCRIPTION OF THE DRAWINGS

Embodiments of the invention will now be described by way of example only and with reference to the accompanying drawings.

DETAILED DESCRIPTION

Reducing the weight of a munition tends to provide a number of advantages, such as reducing the burden on loaders operating within vehicles. Further, as the weight of a sabot in tank shot is effectively parasitic in nature, reducing its weight will decrease the amount of kinetic energy lost. This will allow the penetrator (otherwise known as the sub-projectile) to effectively carry more kinetic energy with an increased velocity and energy density upon impact.

The present invention provides this reduction in weight of the sabot by manufacturing at least a part of the sabot from a material having a lattice (or in other words mesh, matrix, or honeycomb) structure. Due to the extremely high forces acting on the munition when the munition is fired, causing the munition to accelerate with tens of thousands times the acceleration due to gravity (g), the skilled person would be prejudiced against modifying any part of the munition.

While the present invention is applicable to any type of munition, such as High Explosive Anti-Tank (HEAT) shells, mortar rounds, and Armour-Piercing Discarding Sabot (APDS) shots, it is particularly applicable to or Armour-Piercing Fin-Stabilised Discarding Sabot (APFSDS) shots. Munitions can be fired from small arms, ships, artillery and armoured vehicles such as tanks.

Figure 1:
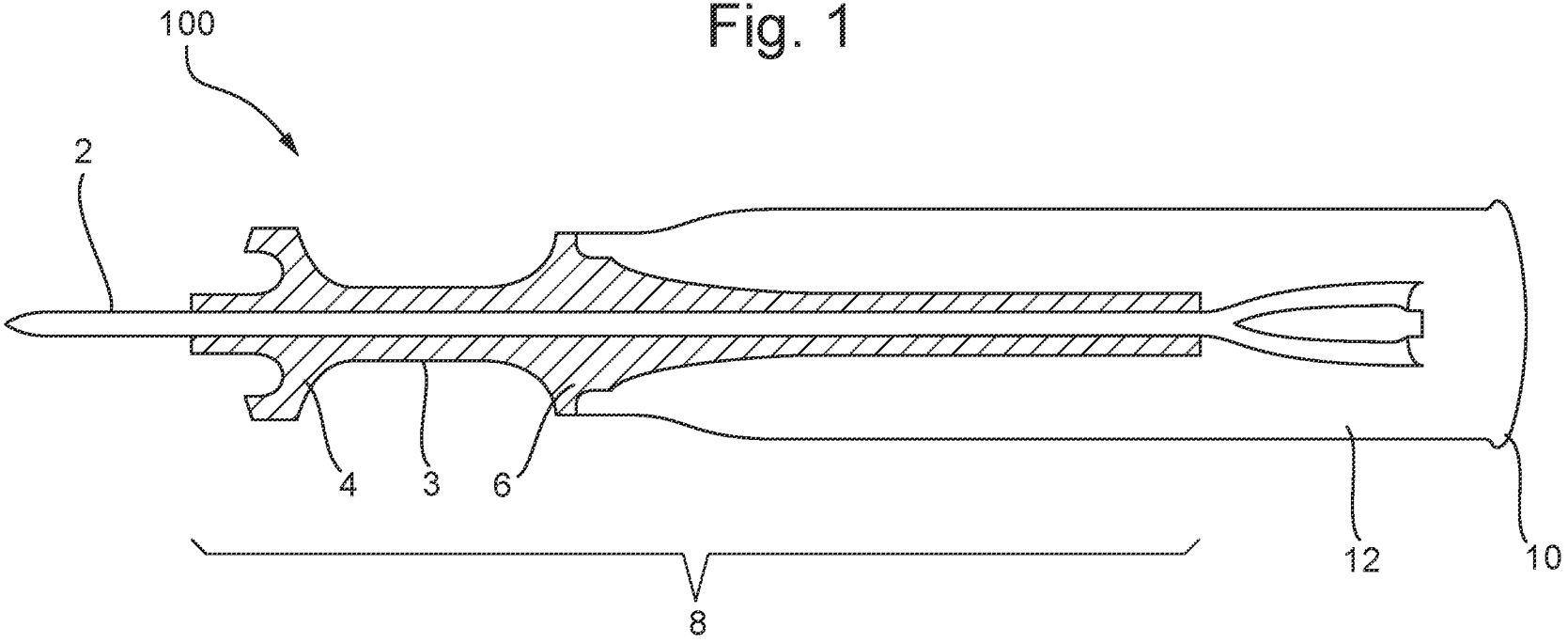
FIG. 1 is a cross-section of a munition and munition casing according to an aspect of the present invention.

A munition 100 having a projectile and munition casing is shown in FIG. 1. FIG. 1 shows a specific tank shot 100 having a sabot 8, which is designed to be fired from a smoothbore gun barrel. However, it would be appreciated that the present invention is applicable to other types of tank shots, such as those fired from rifled gun barrels. The munition 100 in FIG. 1 is a type of APFSDS shot. In some embodiments, there is no munition casing. Here, instead the munition 100 comprises only the penetrator 2 and sabot 8.

The cartridge 10 includes propellant 12 for launching the combined penetrator 2 and sabot 8. The sabot 8 serves as a plug for one end of the cartridge 10. In addition to providing a seal for open end of the cartridge 10, the sabot 8 is arranged to guide the projectile through the gun barrel.

Figure 2:
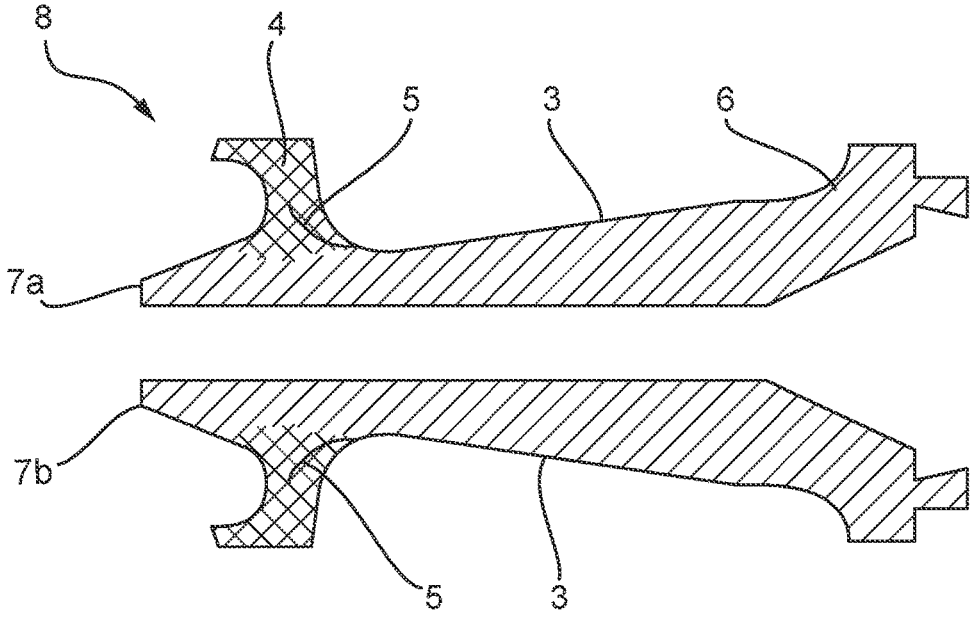
FIG. 2 is a cross-section of a sabot according to an aspect of the present invention.

The sabot 8 is shown in more detail in FIG. 2, which may not require the cartridge 10 in some embodiments. The sabot 8 is formed of at least two petals 7*a*, 7*b* arranged parallel to each other and longitudinally along the penetrator 2. In a preferred embodiment, there are three petals 7*a*, 7*b*. The petals are bound together to encase the penetrator 2 around its longitudinal axis using a nylon or rubber band.

The sabot 8, when the petals 7*a*, 7*b* are combined, includes a front scoop 4, main body 3, and an obturator 6. The front scoop 4 is a scoop disposed toward the front the main body 3 and has a relatively high air resistance. The shape of the front scoop 4 causes the at least two petals 7*a*, 7*b* to be drawn away from the penetrator 2 with such force that the nylon or rubber band breaks when the sabot 8 is fired from the gun barrel. For a rifled gun barrel, the sabot 8 has a ring disposed around the outer circumference of the front scoop 4 and a ring disposed around the outer circumference of the obturator 6 for engaging with the rifling on the inside of the gun barrel.

In some embodiments, the internal structure of the front scoop 4 is formed of a material having a lattice structure. The lattice has a density of greater than 15% volume fraction. A lattice having density of 7.5% volume fraction was found to lack sufficient structural integrity. The density is preferably much less than the density of a solid i.e. the lattice has a density between 15% and 80% volume fraction. Volume fraction is a term of art used to describe the amount of a given volume occupied by a material. The external structure of the front scoop 4 is solid. As defined here, a solid has substantially no cavities or voids, other than those created by the natural process of casting, forging or curing etc., whereas a lattice has intentionally-created spaces between rows or columns of the deposited material.

Preferably, the sabot 8 as a whole is made of the same material, albeit in different structural configurations in different parts. The material is preferably a sintered powdered metal. The powdered metal to be sintered is preferably selected from a titanium alloy, aluminium alloy, or an Inconel. For example, the powdered metal is selected from one of Ti6ALI4v, Inconel 718 and A20X.

Figure 3:
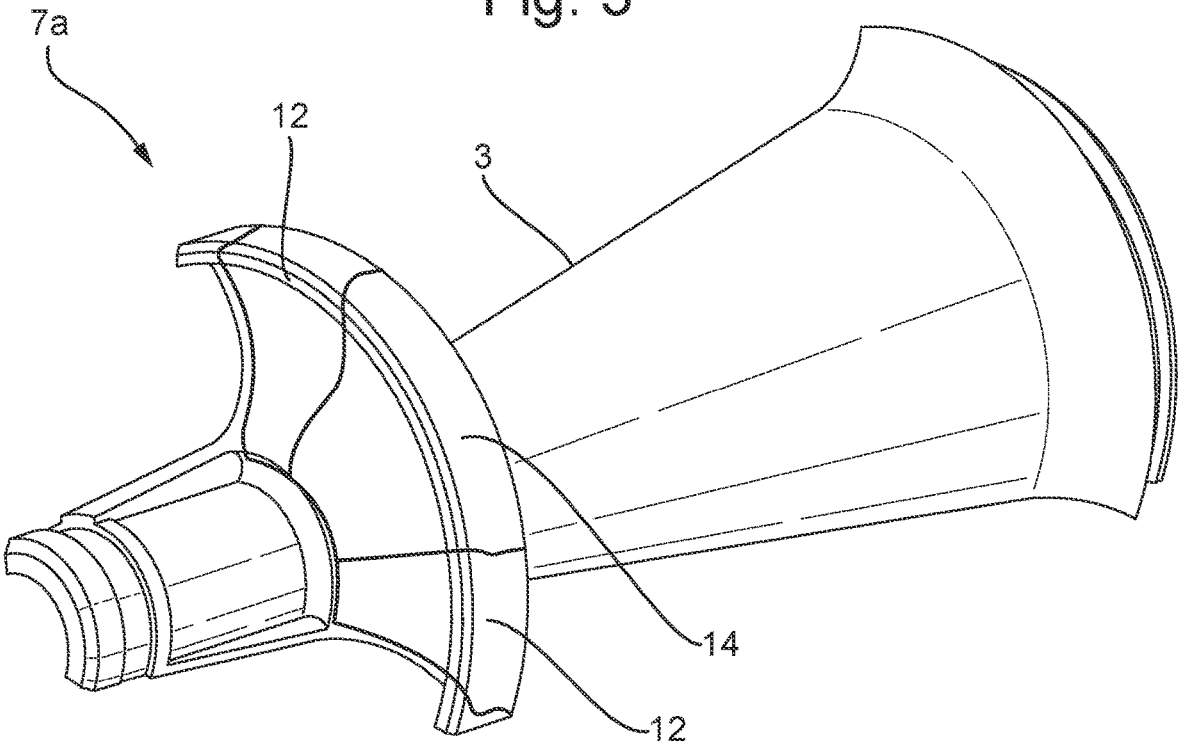
FIG. 3 is a perspective view of a sabot petal according to an aspect of the present invention.

In some embodiments, the internal structure of the front scoop 4 is formed of two different material structures to enhance structural strength and rigidity. The two different material structures may be lattices of different densities. This is shown in FIG. 3. Here, a material having a first material structure is disposed in a first region 12, and the same material having a different material structure is disposed in a second region 14. The two regions 12, 14 are disposed adjacent to each other. Each region extends from one periphery of the front scoop 4 to the other periphery i.e. each region extends from the point at which the front scoop meets the main body 3 to the outermost part of the front scoop 4. Each region 12, 14 extends through the full depth of the front scoop 4, i.e. from front to back, where the back of the front scoop 4 is the side facing the obturator 6.

In other embodiments, the region 12 having the first material structure is disposed adjacent to the region 14 having the second material structure within the front scoop 4 and axially with respect to the main axis of the sabot 8. In other words, here one region 12 is disposed behind another 14, where each of the regions 12, 14 have different densities. In further embodiments still, the region 12 having the first material structure is disposed adjacent to the region 14 having the second material structure within the front scoop 4 and radially with respect to the main axis of the sabot 8. In other words, here one region 12 is disposed above another 14, where each of the regions 12, 14 have different densities.

Alternatively, the material structure of one region may be a lattice while the other is a dense solid.

In one embodiment, shown in FIG. 2, the two material structures are divided by a solid rib (or spar) 5 extending circumferentially around the inside of the front scoop 4. The rib 5 is an extension of the main body 3, and extends into the internal part of the front scoop 4. In alternative embodiments again, the rib 5 may be used to separate lattices of the same density, or arranged to separate adjacent regions of different material structures regardless of their displacement relative to each other.

The main body 3 is the weakest part of the sabot 8. Nevertheless, in some embodiments part of the internal structure of the main body 3 is formed of a lattice structure while the remaining internal structure is solid. The main body 3 may include lattice structures of different densities to each other.

The obturator 6, at the rear of the main body 3, is coupled to the open end of the cartridge 10 in the specific embodiment shown in FIG. 1. In other embodiments, the obturator 6 is freely disposed adjacent to a charge bag. When ignited, the propellant 12 applies force to the obturator 6 to drive the sabot 8 and penetrator 2 out of the gun barrel. Therefore, the obturator 6 is subject to relatively high pressures. As with the front scoop 4, the obturator 6 has a solid external structure (or skin), but in some embodiments the internal structure comprises a lattice structure. The obturator 8 may comprise a lattice structure instead of or in addition to the front scoop 4 and main body 3. The obturator 8 may comprise a plurality of lattice structures. The plurality of lattice structures may be of different densities to each other.

The sabot 8 is manufactured using additive layer manufacturing (ALM). Here, each petal 7*a*, 7*b* is built up in a series of layers such that the lattice structure and solid structure are formed of the same material sequentially without interruption. In other words, the front scoop 4, main body 3 and obturator 6, one or more of which comprise a lattice structure, are integrally formed.

Where, in the foregoing description, integers or elements are mentioned that have known, obvious, or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as optional do not limit the scope of the independent claims. Moreover, it is to be understood that such optional integers or features, while of possible benefit in some embodiments of the disclosure, may not be desirable, and can therefore be absent, in other embodiments.

The invention claimed is:

1. A sabot comprising:

a main body;

an obturator at a rear end of the main body; and a front scoop at a front end of the main body, the front scoop comprising at least two forward-facing concave petals radially bound together around the main body and arranged parallel to each other along a longitudinal axis of the main body, the front scoop comprising a region having a first material structure, a rib extending from the main body and circumferentially around an inside of the at least two petals and the rib comprising a second material structure, the at least two petals configured to be separated from the main body and from each other in response to air resistance upon the front scoop, wherein the first material structure of the region is a lattice and the second material structure of the rib is a solid.

2. The sabot according to claim 1, wherein the main body and/or the obturator comprise at least the first material structure.

3. The sabot according to claim 1, wherein the obturator comprises at least the first material structure.

4. The sabot according to claim 1, wherein the front scoop comprises the first material structure and a third material structure, wherein the third material structure is a lattice.

5. The sabot according to claim 4, wherein the lattice of the third material structure has a different density to that of the first material structure.

6. The sabot according to claim 5, wherein the first material structure is disposed in a first region of the front scoop and the third material structure is disposed in a second region of the front scoop, wherein the first and second regions are disposed adjacent to one another and each extend from an inner rim of the front scoop to an outer rim of the front scoop.

7. The sabot according to claim 4, comprising a sintered powdered metal, wherein the first, second and third material structures are formed from the same sintered powdered metal.

8. The sabot according to claim 6, wherein the rib is arranged to separate the first region and the second region.

9. The sabot according to claim 1, wherein the lattice of the first material structure is greater than 15% volume fraction and less than 80% volume fraction.

10. The sabot according to claim 1, comprising a sintered powdered metal, wherein the first and second material structures are formed from the same sintered powdered metal.

11. A munition comprising the sabot according to claim 1.

12. A munition comprising the sabot according to claim 5.

13. A method of manufacturing a sabot, the method comprising:

forming a main body including a rib, an obturator at a rear end of the main body, and a front scoop at a front end of the main body, the front scoop comprising at least two forward-facing concave petals radially bound together around the main body and arranged parallel to each other along a longitudinal axis of the main body, wherein forming the front scoop comprises forming a region having a first material structure, the rib extending from the main body and circumferentially around an inside of the at least two petals and comprising a second material structure, the at least two petals configured to be separated from the main body and from each other in response to air resistance upon the front scoop, wherein the first material structure of the region is a lattice and the second material structure of the rib is a solid.

14. The method according to claim 13, wherein forming the main body, obturator, and front scoop comprises using additive layer manufacturing.

15. The method according to claim 13, wherein forming the main body and/or the obturator comprises forming the main body and/or the obturator at least of the first material structure.

16. The method according to claim 13, wherein forming the obturator comprises forming the obturator of at least the first material structure.

17. The method according to claim 14, comprising forming the front scoop of at least the first material structure and a third material structure.

18. The method according to claim 17, wherein the first and third material structures are lattices of different densities to each other.

19. The method according to claim 17, comprising forming the rib such that it separates the first and third material structures.

20. The method according to claim 13, comprising forming the front scoop of at least the first material structure and a third material structure.

* * * * *